US007802315B2

(12) United States Patent
Contant et al.

(10) Patent No.: US 7,802,315 B2
(45) Date of Patent: Sep. 28, 2010

(54) HOCKEY GLOVE

(75) Inventors: Mathieu Contant, Verdun (CA); Jean-François Laperrière, Prévost (CA); Conrad Payeur, Prévost (CA); Marie-Claude Généreux, Ste-Thérèse (CA)

(73) Assignee: Bauer Hockey, Inc., Greenland, NH (US)

( * ) Notice: Subject to any disclaimer, the term of this patent is extended or adjusted under 35 U.S.C. 154(b) by 536 days.

(21) Appl. No.: 11/964,932

(22) Filed: Dec. 27, 2007

(65) Prior Publication Data

US 2009/0165185 A1 Jul. 2, 2009

(51) Int. Cl.
*A41D 19/00* (2006.01)

(52) U.S. Cl. ..... 2/161.1; 2/16

(58) Field of Classification Search ..... 2/16, 2/20, 21, 161.1, 161.6, 163; 128/879, 880; 602/21.22

See application file for complete search history.

(56) References Cited

U.S. PATENT DOCUMENTS 1,951,190 A * 3/1934 Gambee
4,272,849 A * 6/1981 Thurston et al.
6,543,057 B2 4/2003 Béland et al.
6,813,781 B2 11/2004 Wilder et al.
7,313,831 B2 * 1/2008 Wilder et al.
7,320,145 B2 * 1/2008 Hochmuth
7,574,748 B2 * 8/2009 Fisher et al.

* cited by examiner

*Primary Examiner*—Katherine Moran

(57) ABSTRACT

A hockey glove having a thumb member comprising a top layer and a bottom layer affixed together at their respective peripheries for defining a cavity, a thumb pocket for receiving the thumb, and a rigid thumb skeleton enclosed in the cavity, the rigid thumb skeleton comprising a first section for covering at least partially the proximal phalanx of the thumb, a second section for covering at least partially the middle phalanx of the thumb and a third section for covering at least partially the distal phalanx of the thumb, wherein the second section comprises a proximal slot extending between first and second ends and a distal slot extending between first and second ends. The rigid thumb skeleton further comprises a proximal pin passing through the proximal slot of the second section and a distal pin passing through the distal slot of the second section. In use, when the second section pivots relative to the first section towards the closed position, the proximal pin abuts the second end of the proximal slot to prevent overbending of the thumb, and when the third section pivots relative to the second section towards the closed position, the distal pin abuts the first end of the distal slot to prevent overbending of the thumb; and when the second section pivots relative to the first section towards the open position, the proximal pin abuts the first end of the proximal slot to prevent hyperextension of the thumb, and when the third section pivots relative to the second section towards the open position, the distal pin abuts the second end of the distal slot to prevent hyperextension of the thumb.

21 Claims, 15 Drawing Sheets

HOCKEY GLOVE

FIELD OF THE INVENTION

The present invention relates to a hockey glove having an articulated rigid thumb skeleton.

BACKGROUND OF THE INVENTION

U.S. Pat. No. 6,813,781 entitled Protective Glove with Articulated Locking Thumb issued on Nov. 9, 2004. This patent discloses a hockey glove having a thumb member comprising a rigid articulating skeleton having at least two sections pivotably joined together at a pivot and a stop adapted to prevent hyperextension of the thumb. The pivot is disposed on the palm side of the thumb member and the stop is disposed on the back side of the thumb member.

U.S. Pat. No. 6,543,057 entitled Protective Sporting Glove issued on Apr. 8, 2003. This patent discloses a hockey glove having a thumb-receiving portion comprising a rigid thumb skeleton having first and second shell portions that partially overlap one another, the first shell portion covering at least partially the middle phalanx of the thumb, the second shell portion covering at least partially the distal phalanx of the thumb, the first shell portion being hinged to the second shell portion.

There is a need in the industry to provide a hockey glove that increases freedom of movement of the thumb of the player while preventing overbending and hyperextension of the thumb.

SUMMARY OF THE INVENTION

As embodied and broadly described herein, the present invention provides a hockey glove for enclosing a human wrist and hand, the hand having a dorsal side, a palm side, fingers and a thumb having a dorsal side, an inner side, a proximal phalanx, a middle phalanx, a distal phalanx and a middle articulation between the proximal and middle phalanxes and a distal articulation between the middle and distal phalanxes, the hockey glove comprising a hand-receiving portion comprising a palm side for facing the palm side of the hand; a dorsal side for facing the dorsal side of the hand; finger sheaths for receiving the fingers of the hand; and a thumb member comprising a top layer and a bottom layer affixed together at their respective peripheries for defining a cavity, a thumb pocket for receiving the thumb, and a rigid thumb skeleton enclosed in the cavity, the rigid thumb skeleton comprising a first section for covering at least partially the proximal phalanx of the thumb, a second section for covering at least partially the middle phalanx of the thumb and a third section for covering at least partially the distal phalanx of the thumb, wherein: (a) the first section comprises a top wall and left and right sides extending longitudinally from a first proximal end to a first distal end, the top wall comprising an underhanging portion at the first distal end; (b) the third section comprises a top wall and left and right sides extending longitudinally from a third proximal end to a third distal end, the top wall comprising an underhanging portion at the third proximal end; (c) the second section comprises a top wall and left and right sides extending longitudinally from a second proximal end to a second distal end, the top wall comprising a proximal recess for receiving the underhanging portion of the first section and the underhanging portion of the third section, the second proximal end having a proximal slot extending between first and second ends, and the second distal end having a distal slot extending between first and second ends; and wherein the underhanging portion of the first section is affixed within the proximal recess of the second section for hinging together the first and second sections; wherein the underhanging portion of the third section is affixed within the distal recess of the second section for hinging together the second and third sections; wherein the first, second and third sections are rotatable relative to each other between a closed position and an open position; wherein the rigid thumb skeleton further comprises a proximal pin passing through the proximal slot of the second section and a distal pin passing through the distal slot of the second section, the proximal pin being moveable within the proximal slot and the distal pin being moveable within the distal slot; and wherein, in use, when the second section pivots relative to the first section towards the closed position, the proximal pin abuts the second end of the proximal slot to prevent overbending of the thumb, and when the third section pivots relative to the second section towards the closed position, the distal pin abuts the first end of the distal slot to prevent overbending of the thumb; and when the second section pivots relative to the first section towards the open position, the proximal pin abuts the first end of the proximal slot to prevent hyperextension of the thumb, and when the third section pivots relative to the second section towards the open position, the distal pin abuts the second end of the distal slot to prevent hyperextension of the thumb.

The invention also provides a hockey glove for enclosing a human wrist and hand, the hand having a dorsal side, a palm side, fingers and a thumb having a dorsal side, an inner side, a proximal phalanx, a middle phalanx, a distal phalanx and a middle articulation between the proximal and middle phalanxes and a distal articulation between the middle and distal phalanxes, the hockey glove comprising a hand-receiving portion comprising a palm side for facing the palm side of the hand; a dorsal side for facing the dorsal side of the hand; finger sheaths for receiving the fingers of the hand; and a thumb member comprising a top layer and a bottom layer affixed together at their respective peripheries for defining a cavity, a thumb pocket for receiving the thumb, and a rigid thumb skeleton enclosed in the cavity, the rigid thumb skeleton comprising a first section for covering at least partially the middle phalanx of the thumb and a second section for covering at least partially the distal phalanx of the thumb, wherein: (a) the first section comprises a top wall and left and right sides extending longitudinally from a first proximal end to a first distal end, the top wall comprising an underhanging portion at the first distal end; (b) the second section comprises a top wall and left and right sides extending longitudinally from a second proximal end to a second distal end, the top wall comprising a recess for receiving the underhanging portion of the first section, the second proximal end having a slot extending between first and second ends, and wherein the underhanging portion of the first section is affixed within the recess of the second section for hinging together the first and second sections; wherein the first and second sections are rotatable relative to each other between a closed position and an open position; wherein the rigid thumb skeleton further comprises a pin passing through the slot of the second section, the pin being moveable within the slot; and wherein, in use, when the second section pivots relative to the first section towards the closed position, the pin abuts the first end of the slot to prevent overbending of the thumb; and when the second section pivots relative to the first section towards the open position, the pin abuts the second end of the slot to prevent hyperextension of the thumb.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of the embodiments of the present invention is provided herein below, by way of example only, with reference to the accompanying drawings, in which.

Figure 1A:
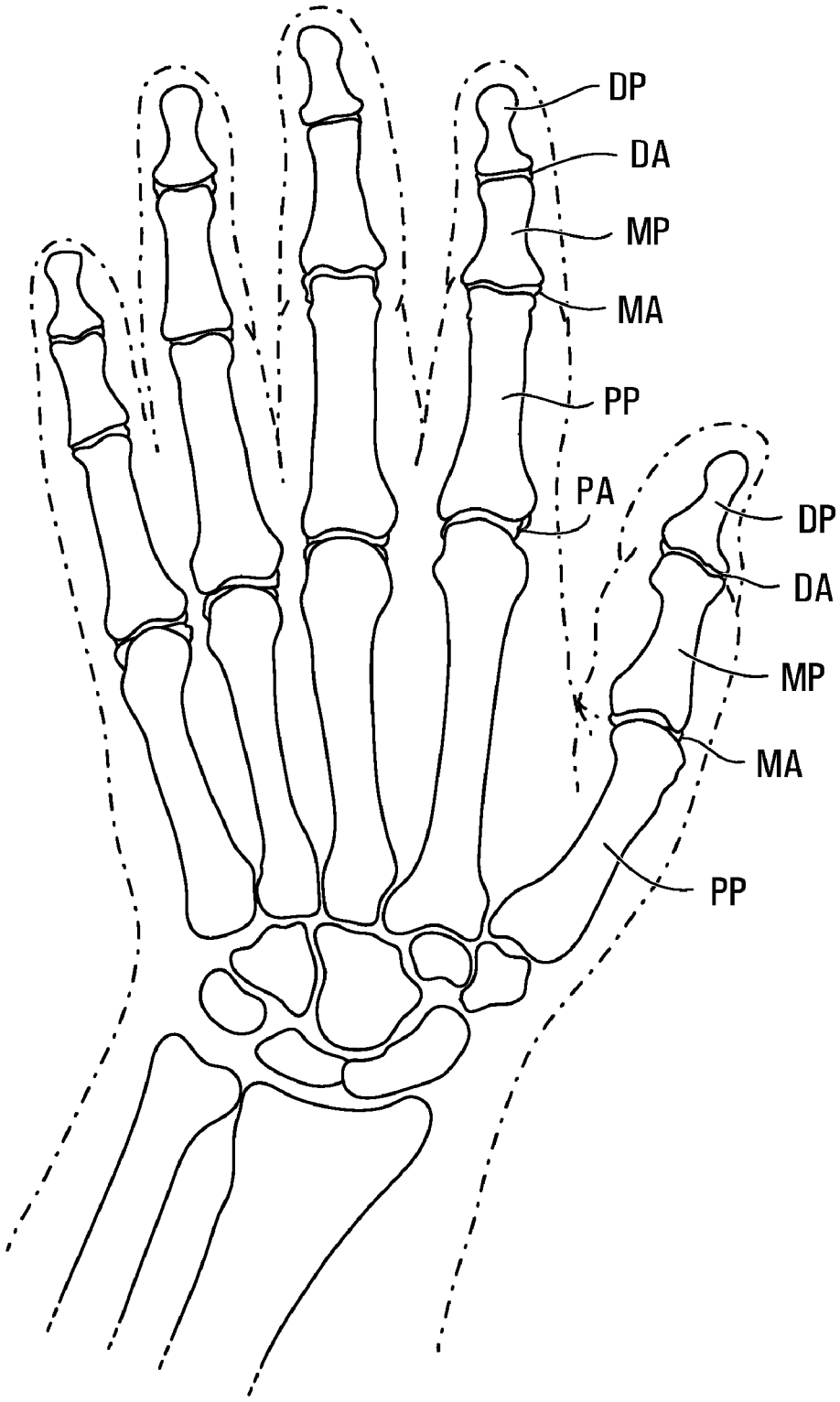
FIG. 1A is a top view of a human hand with the integument of the hand shown in broken lines and the bones shown in full lines.
Figure 1B:
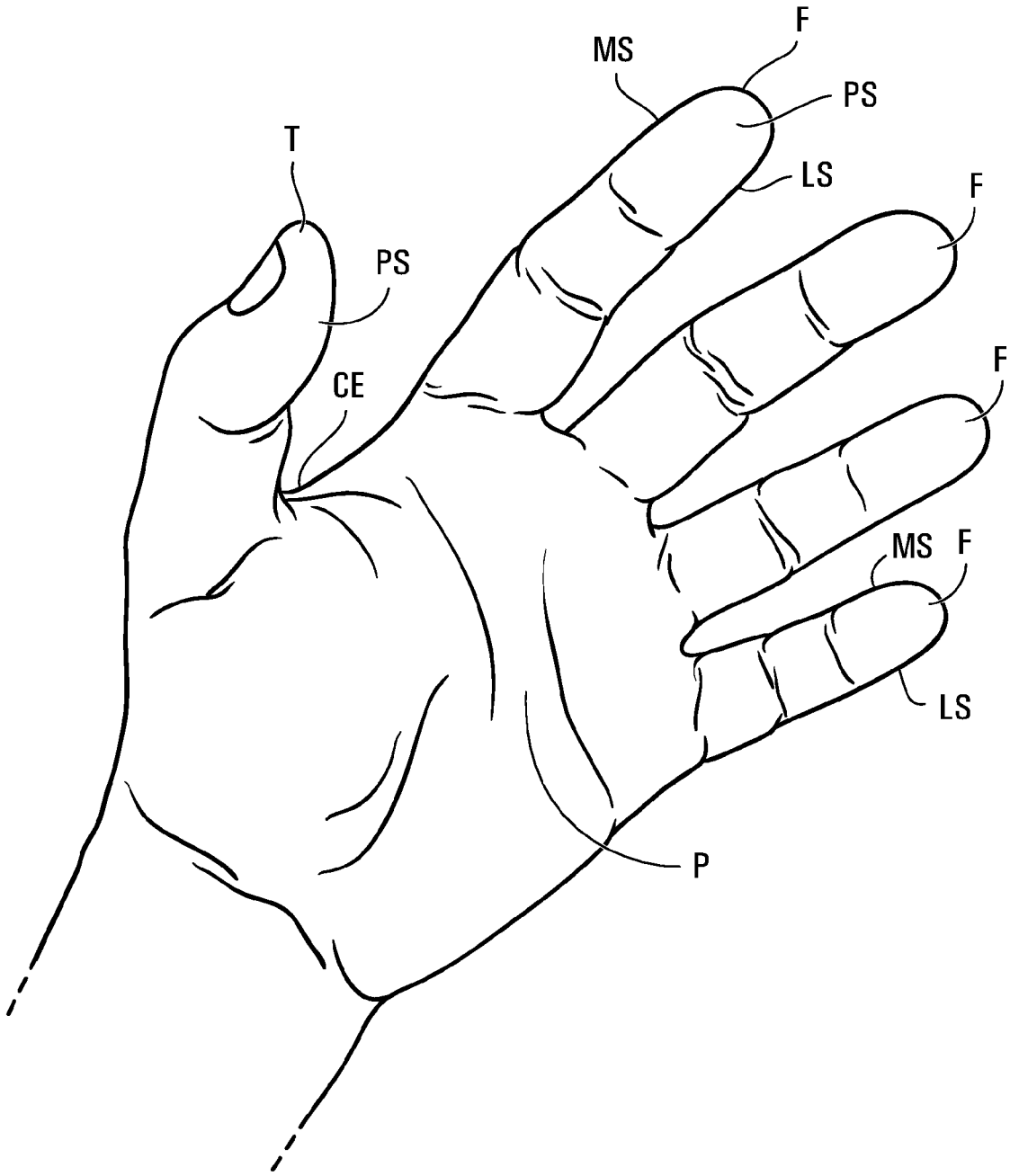
FIG. 1B is a bottom perspective view of a human hand.
Figure 1C:
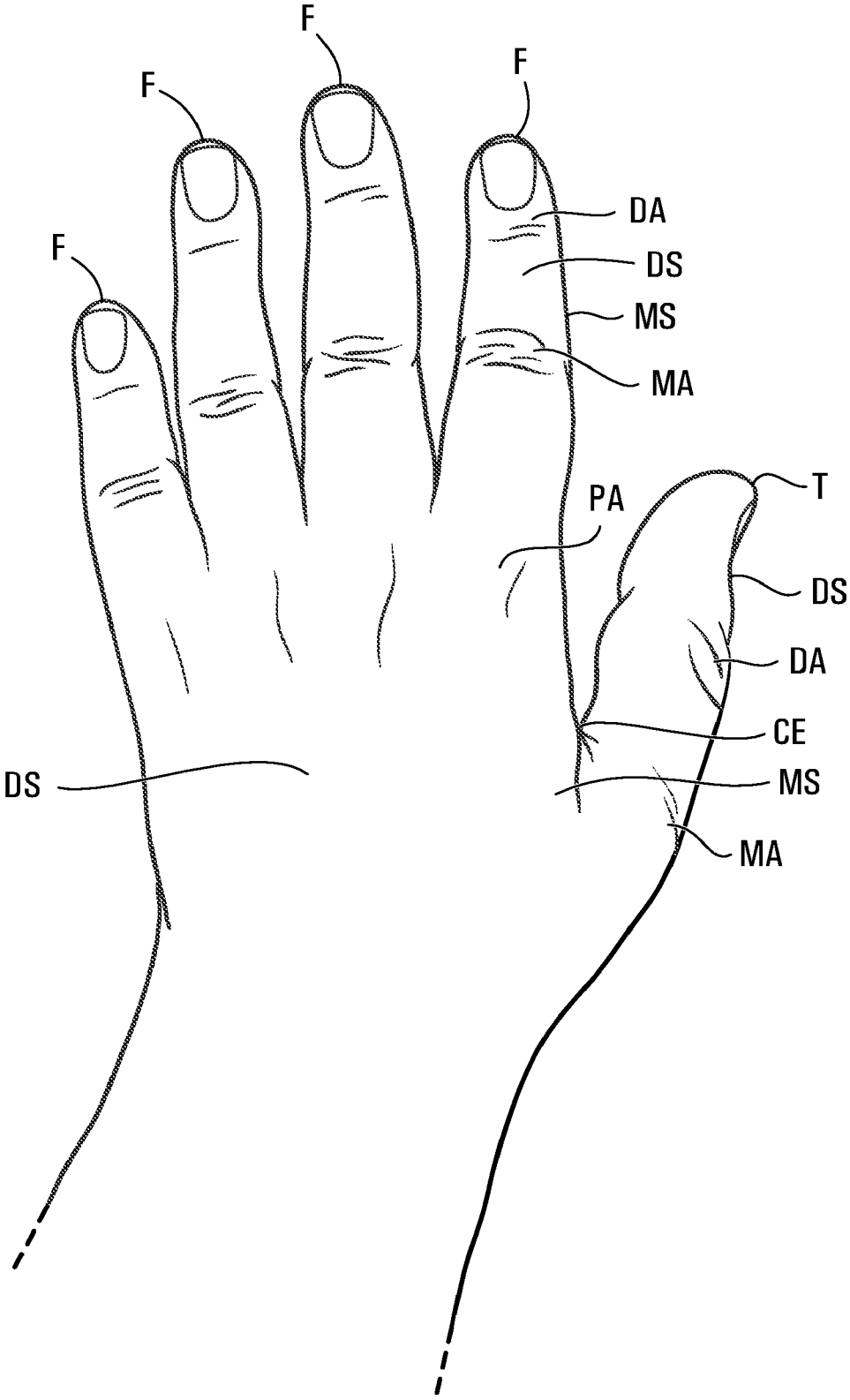
FIG. 1C is a top perspective view of the human hand of FIG. 1B.
Figure 1D:
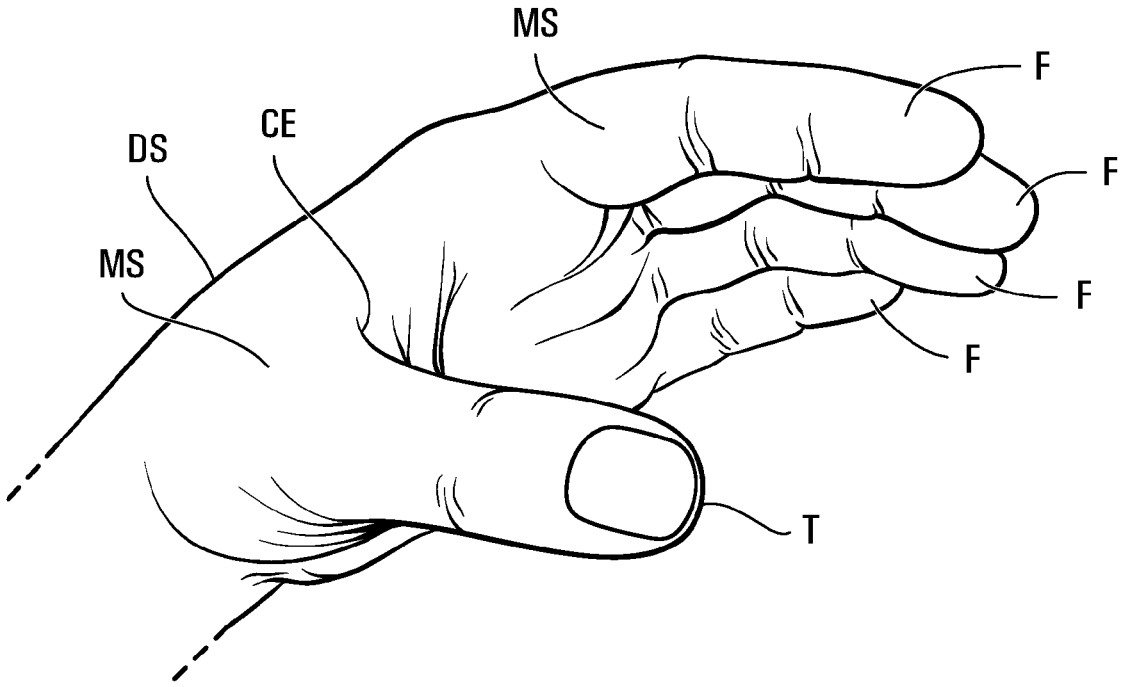
FIG. 1D is a side perspective view of the human hand of FIG. 1B.
Figure 2:
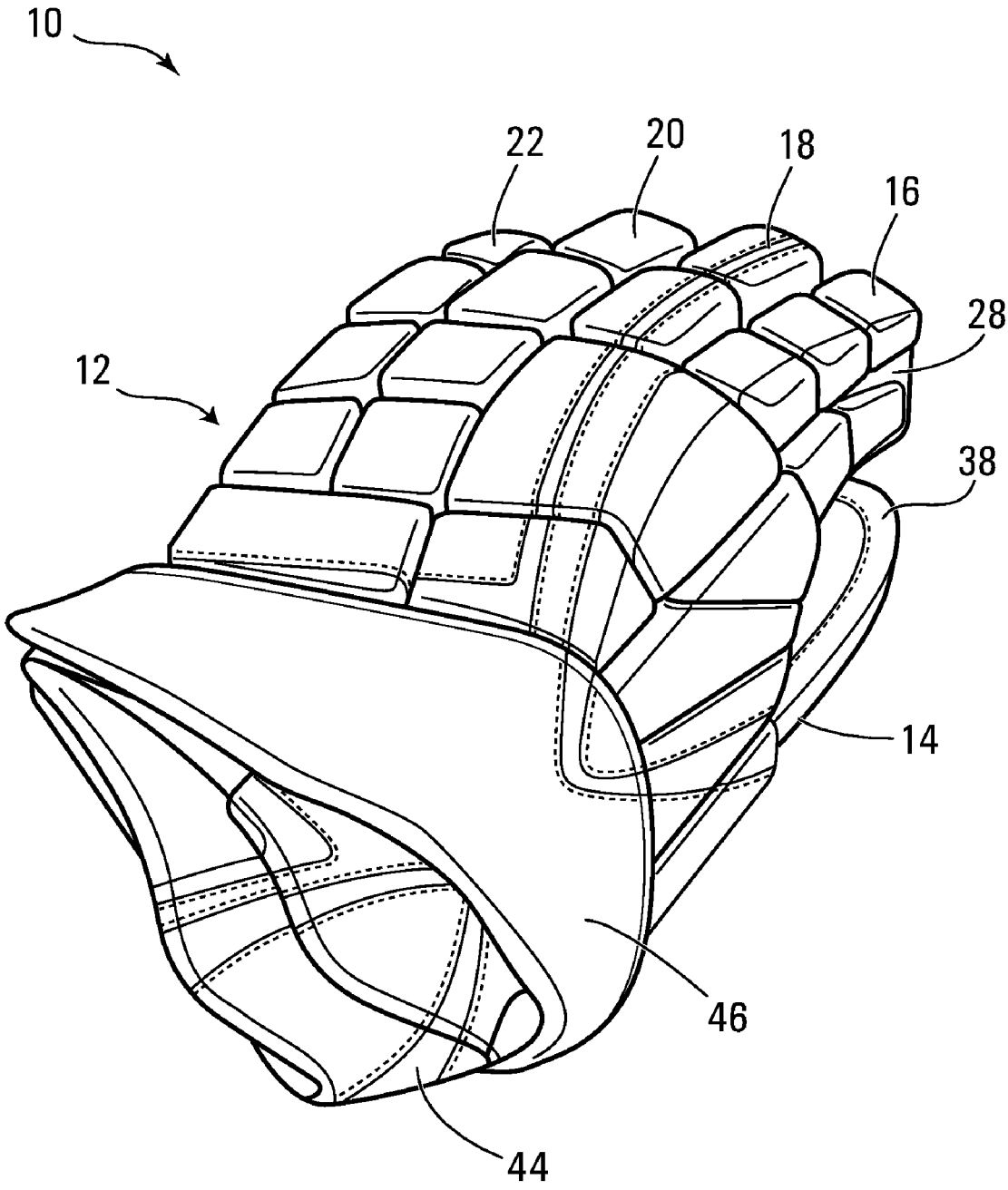
FIG. 2 is a perspective view of a hockey glove constructed in accordance with an embodiment of the invention.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

It should be clearly understood that like reference numerals are intended to identify the same structural elements, parts, portions or surfaces consistently throughout the several drawing figures, as such elements, parts, portions or surfaces may be further described or explained by the entire written specifications, of which this detailed description is an integral part. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

As shown in FIGS. 1A, 1B, 1C, 1D, a human hand comprises a palm P, a dorsal side DS, four fingers F (index finger, middle finger, third finger and little finger), a thumb T and a medial side MS with a C-shaped edge CE extending between the thumb T and the index finger F. Each finger F has a palm surface PS, a dorsal surface DS, a lateral surface LS, a medial surface MS, a proximal articulation PA, a proximal phalanx PP, a middle articulation MA, a middle phalanx MP, a distal articulation DA and a distal phalanx DP. The thumb T has a palm surface PS, a dorsal surface DS, a proximal phalanx PP, a middle articulation MA, a middle phalanx MP, a distal articulation DA and a distal phalanx DP.

FIGS. 2 to 6 illustrate a hockey glove 10 for receiving the hand of the player. The hockey glove 10 has a hand receiving portion 12 for covering the palm P and dorsal side DS of the hand and extending generally to the end of the fingers F and a thumb member 14 for protecting the thumb T.

The hand receiving portion 12 comprises four finger sheaths 16, 18, 20, 22 for enclosing the index finger, middle finger, third finger and little finger, a palm sheet 24 for facing the palm P and the palm surfaces PS of the respective fingers F and the palm surface PS of the thumb T and a dorsal side 26 for covering the dorsal surface DS of the hand. The palm sheet 24 is made of soft flexible material such as leather or synthetic textile material.

Each of the finger sheaths 16, 18, 20, 22 extends from an area proximal the proximal articulation PA of the finger to the end of the finger. Each of the finger sheaths 16, 18, 20, 22 comprises elongated protective finger pads 32 extending along the dorsal side of each finger sheath for protecting the dorsal surface DS of each finger F. A spacer (not illustrated) made of flexible material may fill the gap between the finger pads 32 of the same finger sheath and protects the player's knuckles when the finger sheath is fully bent inwardly. The finger pads 32 are made of materials conventionally found in the prior art. Such materials include polyethylene inserts and may include various composite materials designed to absorb the energy of an impact.

The hand receiving portion also comprises a side finger web 28 for facing the lateral surface LS and medial surface MS of each finger F, this side finger web 28 being connected to the palm sheet 24 and dorsal side 26 for defining finger gussets 30 for enclosing the fingers F. The side finger web 28 is made of an elastic synthetic material for giving added flexibility to each finger sheath while simultaneously facilitating the reduction of the moisture levels within each finger sheath.

The hockey glove 10 further comprises dorsal pads 34 for protecting the dorsal side DS of the hand and side pads 36 for protecting the medial side MS of the hand. The dorsal and side pads 34, 36 may be formed of relatively thick foam encapsulated in suitable material such as leather or NYLON. The dorsal pads 34 are formed and grouped to substantially conform to the shape of the back of the hand and may be oriented in order to increase flexibility of the hand. The dorsal pads 34 are generally rectangular in cross-section.

The hockey glove 10 also comprises a braiding 38 surrounding the periphery of the thumb member 14, extending along a portion between the thumb member 14 and the index finger sheath 16 and further along the side of the index finger sheath 16. The braiding 38 is used to affix a portion of the periphery of the palm sheet 24 to the thumb member 14, to the portion between the thumb member 14 and the index finger sheath 16 and to the side of the index finger sheath 16.

The palm sheet 24 may be made of a four way stretch NYLON fabric, leather or another natural or synthetic material selected for softness and durability and may also include holes for ventilation. The palm sheet 24 may comprise further tabs made of leather provided over the tips of the finger for greater abrasion resistance, improved gripping ability, and extended wear of the hockey glove 10.

The palm sheet 24 may further comprise a reinforcing strip of material 40 extending generally diagonally across the palm sheet 24 from about the index finger to the heel of the palm on the little finger side of the glove. The reinforcing strip of material 40 is preferably oriented to run generally parallel to the stick during the angular grasping of the stick by the player. This orientation aids grip and reduces fatigue by reducing the glove's resistance to grasping the stick at such an angle.

Moreover, the palm sheet 24 may comprise a pad 42 covering at least partially the region of the hand where the ulnar and mediale nerves are located, this pad 42 being made of a suitable material for absorbing detrimental forces associated with the hockey stick-to-puck impact.

The hockey glove 10 also comprises a flexible cuff 44 and a cuff roll 46 that at least partially covers the flexible cuff 44 for offering further protection to the back and sides of the wrist against hits from a hockey stick or the puck.

Figure 3:
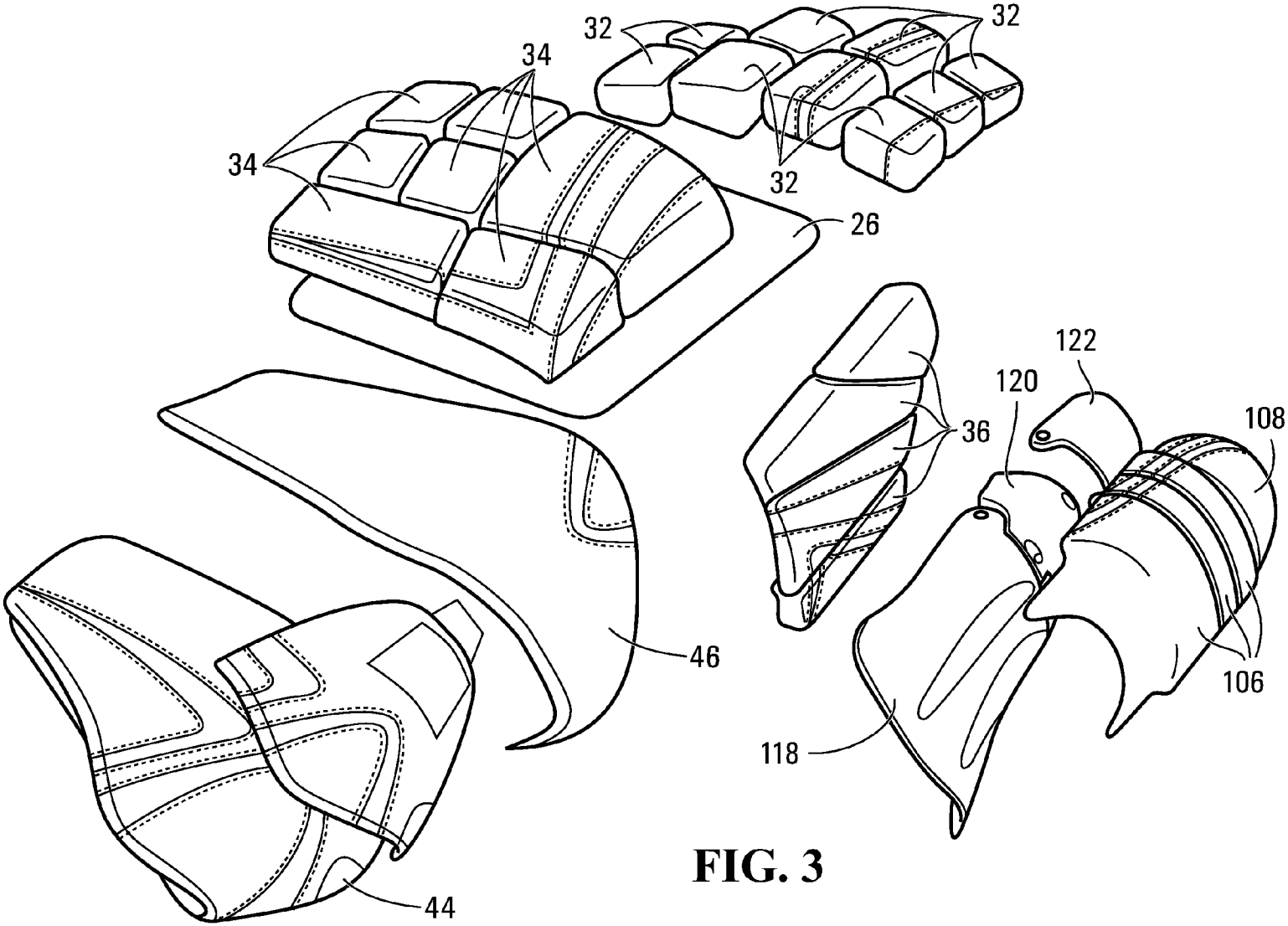
FIG. 3 is an exploded perspective view showing the pads and thumb skeleton of the hockey glove of FIG. 2.
Figure 4:
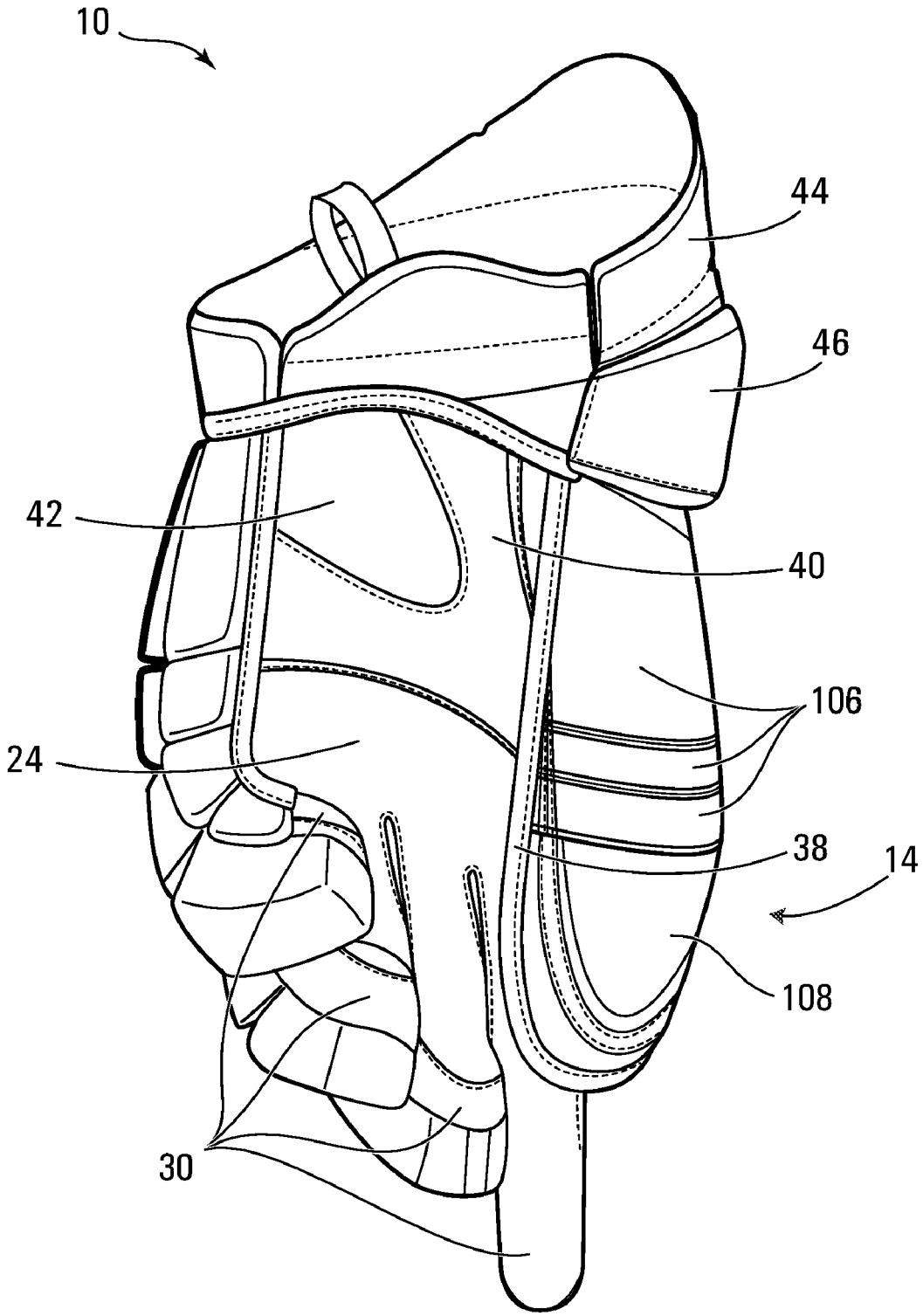
FIG. 4 is a bottom view of the hockey glove of FIG. 2.
Figure 5:
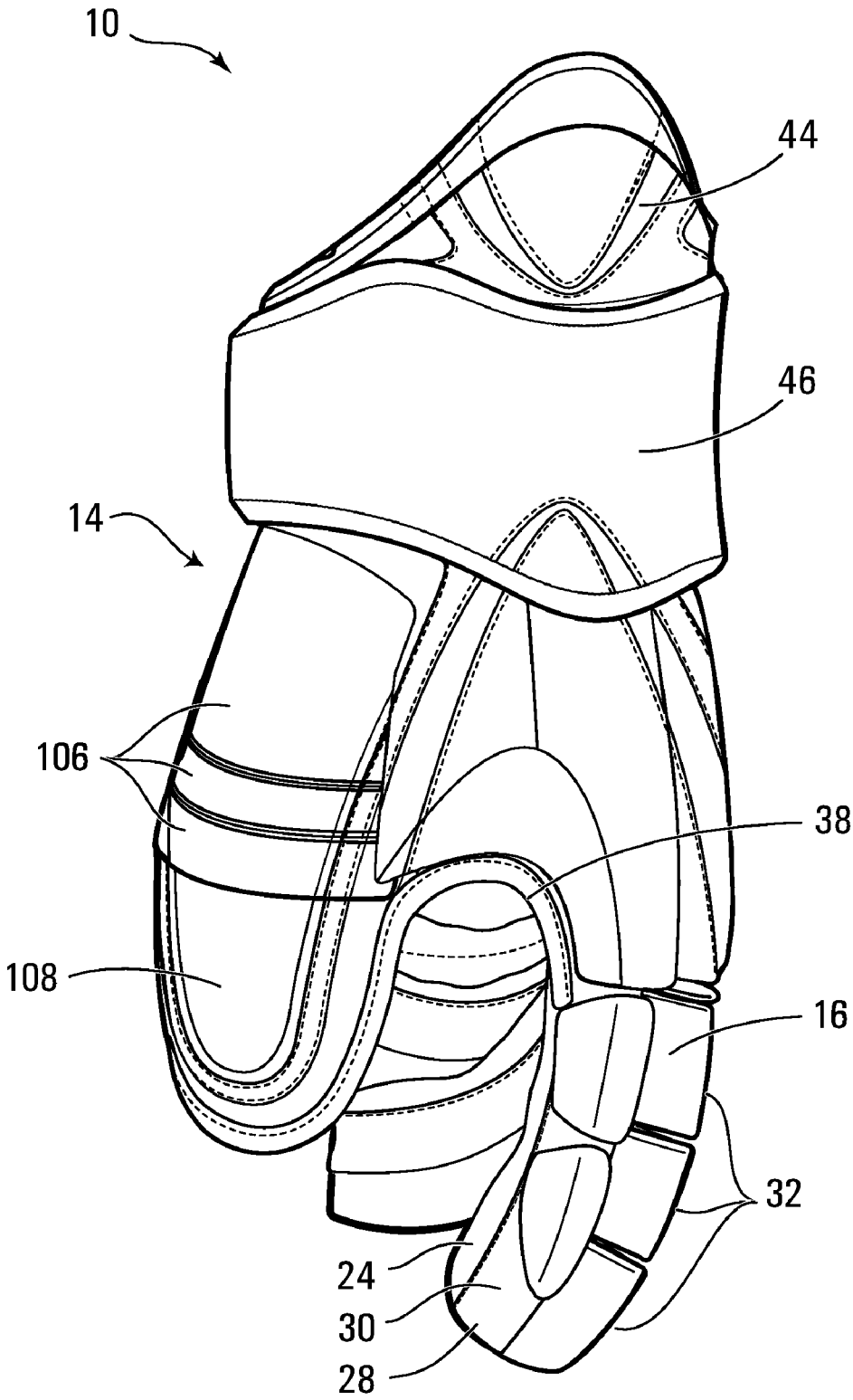
FIG. 5 is a side view of the hockey glove of FIG. 2.
Figure 6:
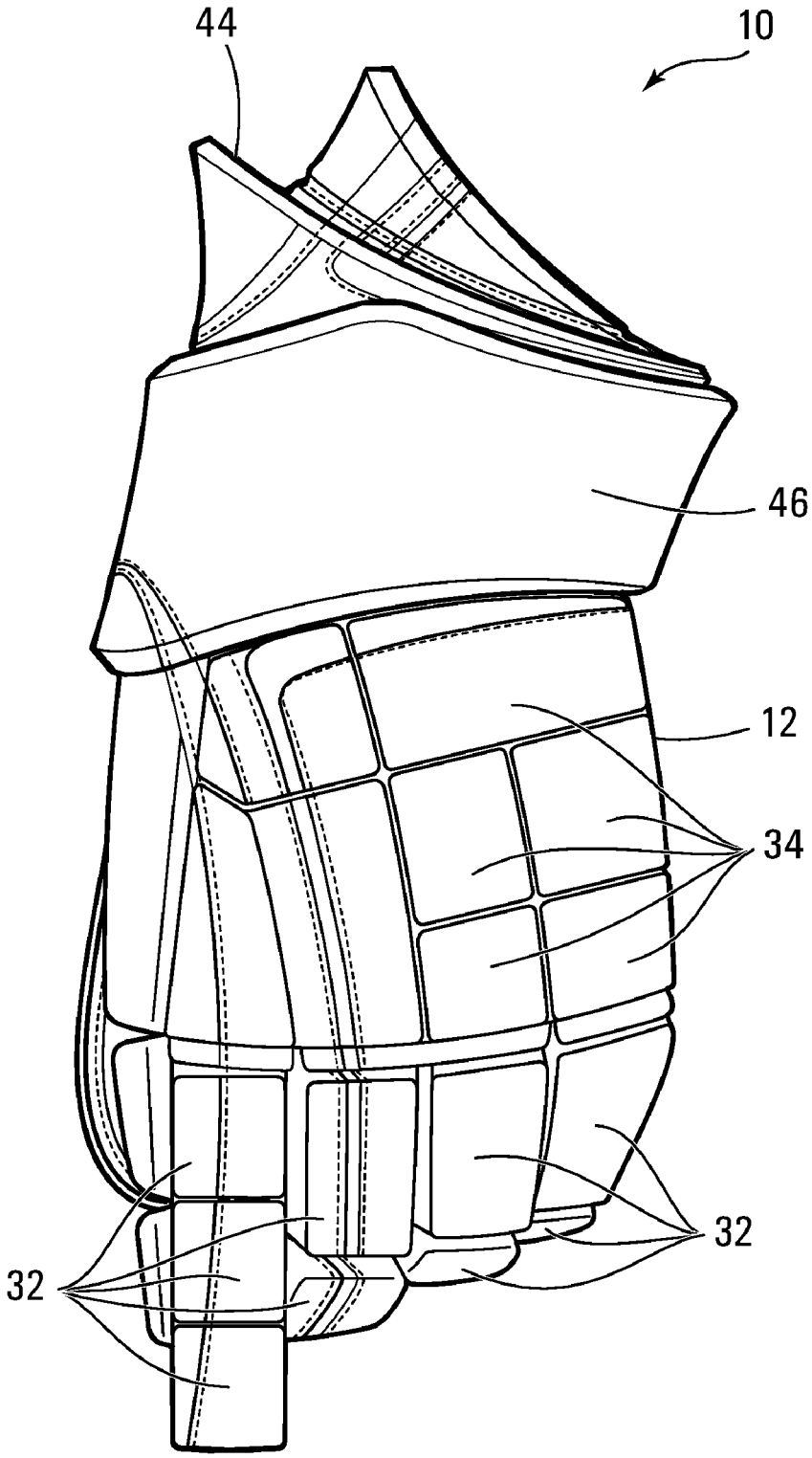
FIG. 6 is a top view of the hockey glove of FIG. 2.
Figure 7:
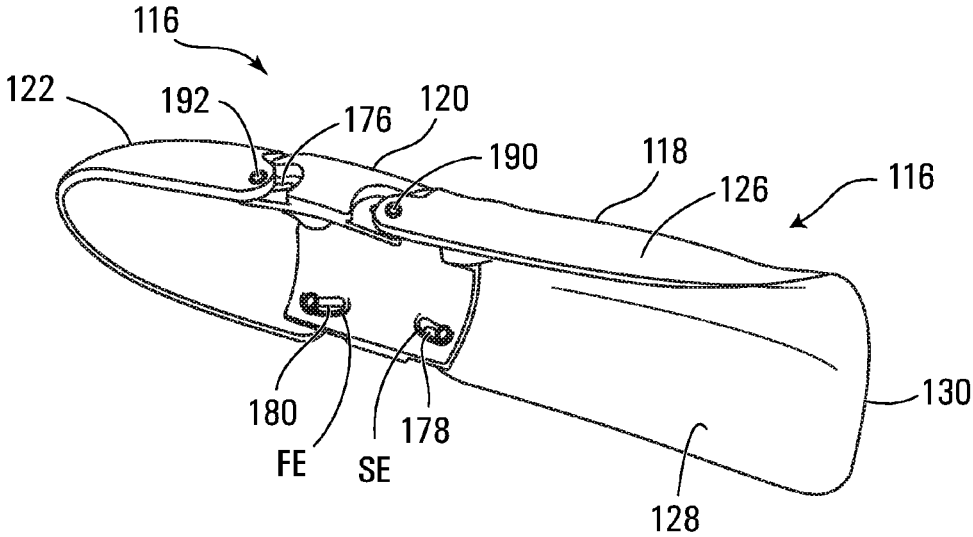
FIG. 7 is a perspective view of the thumb skeleton of the hockey glove of FIG. 2.

As shown in FIGS. 3 and 4, the flexible cuff 44 may comprise segmented panels affixed to the proximal end of the hand receiving portion 12 and the cuff roll 46 extends about two-thirds the distance around the flexible cuff 44. The panels are padded for protection about the wrist. The panels are preferably covered by leather or suitable synthetic materials such as NYLON. Optionally, a fairly rigid member (not shown) may be included in one or more panels for added protection of the wrist. It is preferred that the panels overlap slightly to further safeguard against openings around the wrist which could lead to injury. This flexible cuff 44 allows enhanced flexibility of the glove for the player's hand motions, such as when hitting the hockey puck with the stick. It is understood that the flexible cuff 44 may be affixed to the hand receiving portion 12 via a suitable flexible material (e.g. via an elastic band). The cuff roll 46 may be formed of a section of foam having a thickness of about 0.25 inch to 0.5 inch, which is covered by real or synthetic leather, or other suitable material. The cuff roll 46 is preferably attached only at its short ends.

Figure 13:
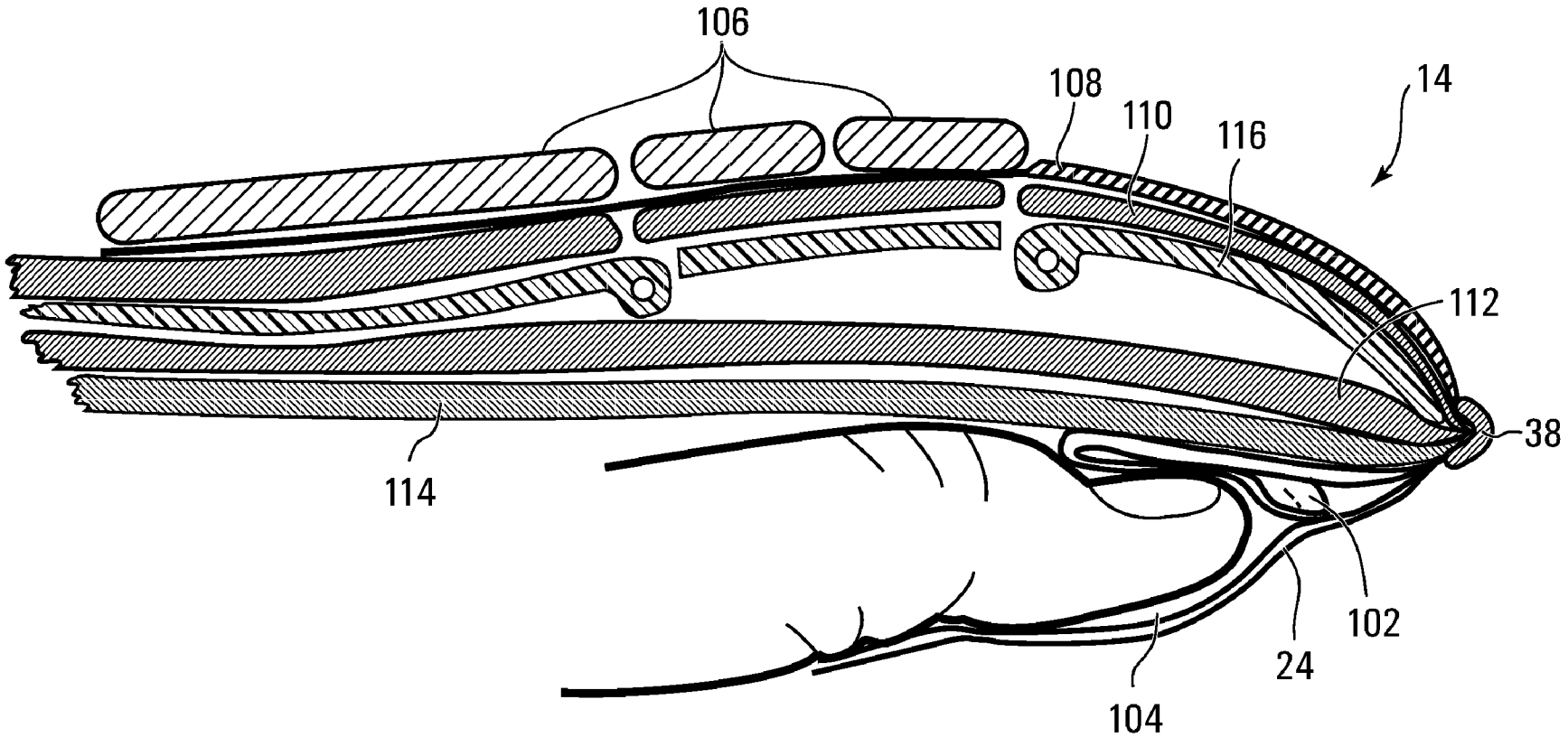
FIG. 13 is an enlarged view of the thumb member of the hockey glove of FIG. 2.
Figure 14:
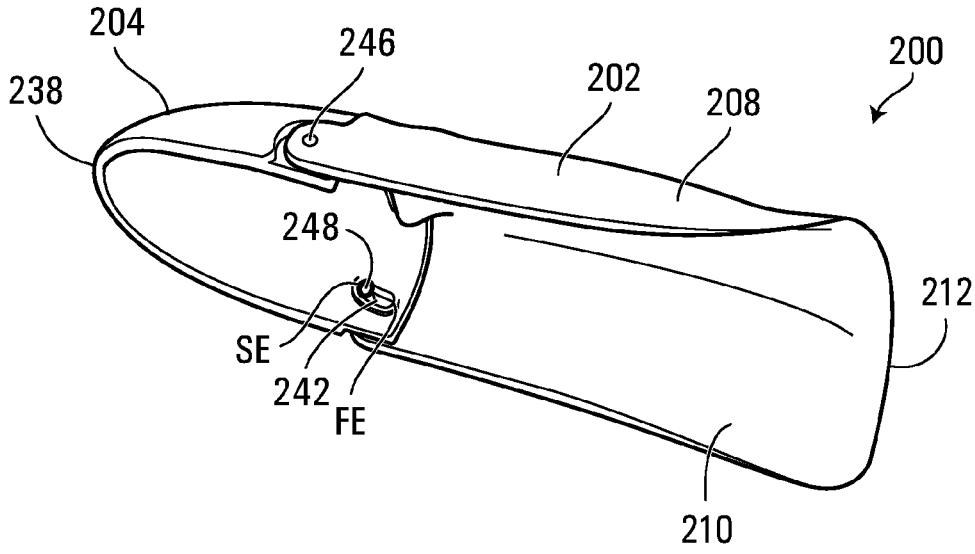
FIG. 14 is a perspective view of a thumb skeleton according to a second embodiment of the invention.
Figure 15:
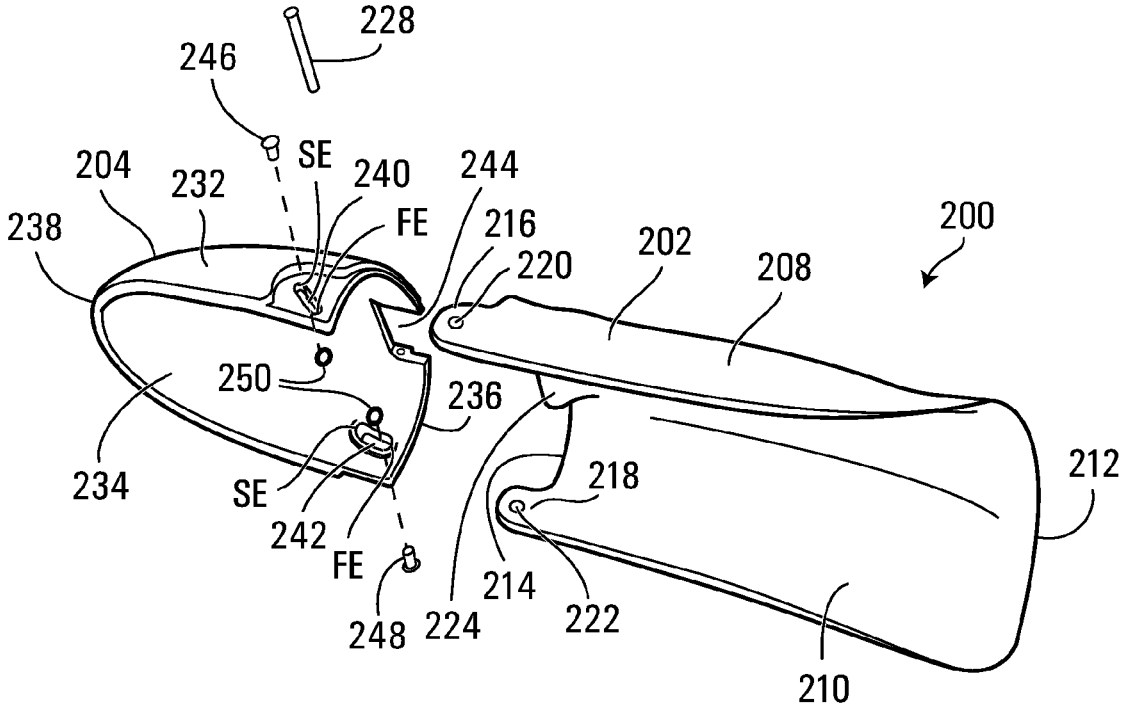
FIG. 15 is an exploded perspective view of the thumb skeleton of FIG. 14.

As shown in FIG. 13, to facilitate thumb movement, the thumb member 14 has a layer 102 forming with the palm sheet 24 a thumb pocket 104 for receiving the thumb T of the player. The thumb pocket 104 allows the thumb T to move with more freedom. The thumb member 14 also comprise one or more pads 106 and an external rigid sheet 108 for protecting the dorsal side of the thumb, top and bottom layers 110, 112 made of polyurethane foam and a bottom liner 114 for facing the dorsal side DS of the thumb. The external rigid sheet 108, top and bottom layers 110, 112 and bottom liner 114 are affixed together at their periphery by the braiding 38. The thumb member 14 further comprises a rigid thumb skeleton 116 sandwiched between the top and bottom layers 110, 112.

Referring to FIGS. 7 to 12, the rigid thumb skeleton 116 comprises a first section 118 for covering at least partially the proximal phalanx PP of the thumb T, a second section 120 for covering at least partially the middle phalanx MP of the thumb T and a third section 122 for covering at least partially the distal phalanx DP of the thumb T. The rigid thumb skeleton 116 may be made of plastic.

The first section 118 comprises a top wall 124 and left and right sides 126, 128 extending longitudinally from a first proximal end 130 to a first distal end 132, the left and right sides 126, 128 comprising left and right portions 134, 136 extending forwardly at the first distal end 132 and comprising respective left and right apertures 138, 140. The top wall 124 comprises an underhanging portion 142 at the first distal end 132.

The third section 122 comprises a top wall 144 and left and right sides 146, 148 extending longitudinally from a third proximal end 150 to a third distal end 152, the left and right sides 146, 148 comprising left and right portions 154, 156 extending rearwardly at the third proximal end 150 and comprising respective left and right apertures 158, 160. The top wall 144 comprises an underhanging portion 162 at the third proximal end 150.

The second section 120 comprises a top wall 164 and left and right sides 166, 168 extending longitudinally from a second proximal end 170 to a second distal end 172, the left and right sides 166, 168 comprising respective left proximal and distal slots 174, 176 and right proximal and distal slots 178, 180. The top wall comprises a proximal recess 182 and a distal recess 184 for receiving the respective underhanging portion 142 of the first section 118 and the underhanging portion 162 of the third section 122.

The thumb skeleton 116 further comprises a first rod 186 for connecting the underhanging portion 142 of the first section 118 within the proximal recess 182 of the second section 120 such that the first and second sections 118, 120 are hinged together near the articulation between the proximal and middle phalanxes PP, MP of the thumb T. To this effect, the underhanging portion 142 has an aperture extending transversely for receiving the first rod 186.

Figure 8:
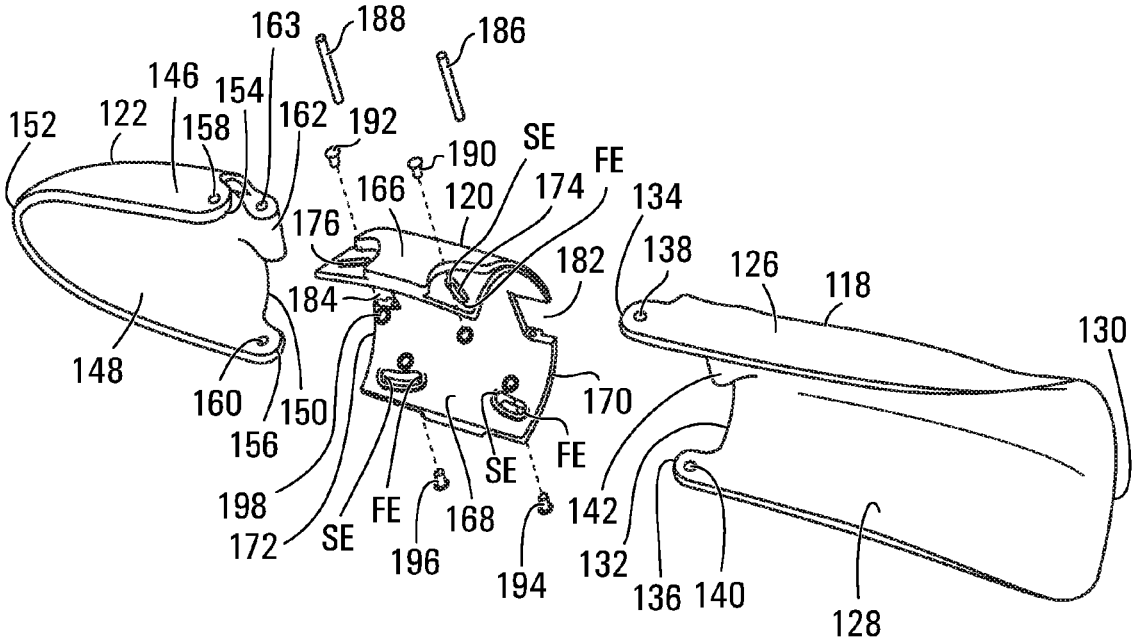
FIG. 8 is an exploded perspective view of the thumb skeleton of FIG. 7.
Figure 9:
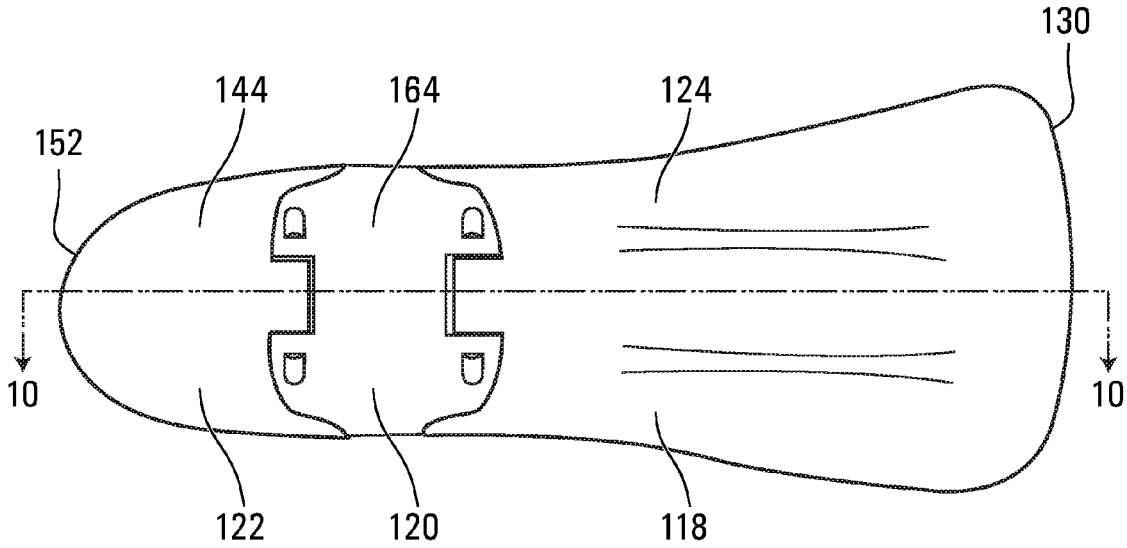
FIG. 9 is a top view of the thumb skeleton of FIG. 7.
Figure 10:
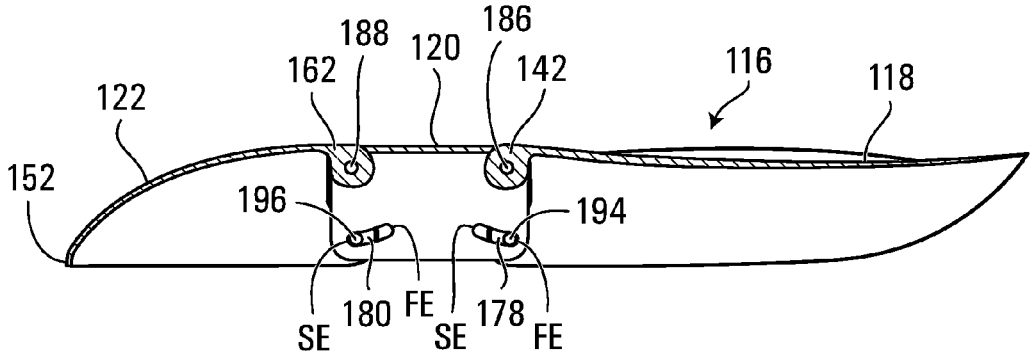
FIG. 10 is a cross-sectional view taken along line 10-10.

The thumb skeleton 116 also comprises a second rod 188 for connecting the underhanging portion 162 of the third section 122 within the 184 distal recess of the second section 120 such that the second and third sections 120, 122 are hinged together near the articulation between the middle and distal phalanxes MP, DP of the thumb T. As best seen in FIG. 8, the underhanging portion 162 has an aperture 163 extending transversely for receiving the first rod 186.

Figure 11:
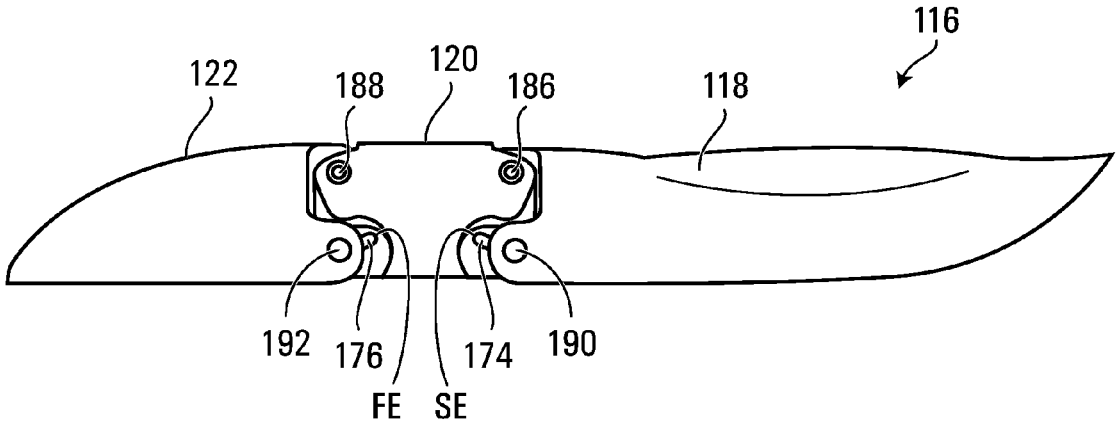
FIG. 11 is a side view of the thumb skeleton of FIG. 7 shown in an open position.
Figure 12:
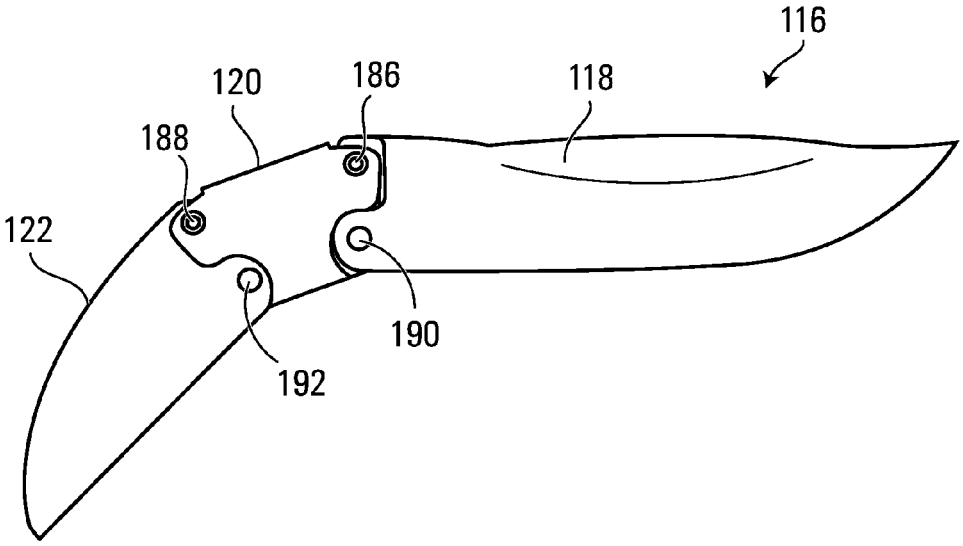
FIG. 12 is a side view of the thumb skeleton of FIG. 7 shown in a closed position.

As shown in FIGS. 11 and 12, the first, second and third sections 118, 120, 122 are rotatable relative to each other between a closed position (FIG. 12) and an open position (FIG. 11).

Reverting to FIGS. 7 to 10, each of the slots 174, 176, 178, 180 has a length with a first end FE and a second end SE. The thumb skeleton 116 further comprises a left proximal pin 190 passing through the left aperture 138 of the first section 118 and the left proximal slot 174 of the second section 120, a left distal pin 192 passing through the left aperture 158 of the third section 122 and the left distal slot 176 of the second section 120, a right proximal pin 194 passing through the right aperture 140 of the first section 118 and the right proximal slot 178 of the second section 120, and a right distal pin 196 passing through the right aperture 160 of the third section 122 and the right distal slot 180 of the second section 120. Locking rings 198 are provided for retaining the respective pins 190, 192, 194, 196. The pins 190, 192, 194, 196 are moveable within the respective slots 174, 176, 178, 180.

In use, when the first and second sections 118, 120 pivot relative to each other towards the closed position, each of the pins 190, 194 abuts the second end SE of each of the respective slots 174, 178 to prevent overbending of the thumb, and when the second and third sections 120, 122 pivot relative to each other towards the closed position, each of the pins 192, 196 abuts the first end FE of each of the respective slots 176, 180 to prevent overbending of the thumb (see FIG. 12).

Moreover, when the first and second sections 118, 120 pivot relative to each other towards the open position, each of the pins 190, 194 abuts the first end FE of each of the respective slots 174, 178 to prevent hyperextension of the thumb, and when the second and third sections 120, 122 pivot relative to each other towards the open position, each of the pins 192, 196 abuts the second end SE of each of the respective slots 176, 180 to prevent overbending of the thumb (see FIG. 11).

As shown in FIGS. 14 to 17, the invention further covers a rigid thumb skeleton 200 comprising two sections instead of three, namely a first section 202 for covering at least partially the middle phalanx of the thumb and a second section 204 for covering at least partially the distal phalanx of the thumb.

In such an embodiment, the first section 202 comprises a top wall 206 and left and right sides 208, 210 extending longitudinally from a first proximal end 212 to a first distal end 214, the left and right sides 208, 210 comprising left and right portions 216, 218 extending forwardly at the first distal end 214 and comprising respective left and right apertures 220, 222. The top wall 206 of the first section 202 comprises an underhanging portion 224 at the first distal end 212, the underhanging portion 224 having an aperture extending transversely for receiving a rod 228.

The second section 204 comprises a top wall 230 and left and right sides 232, 234 extending longitudinally from a second proximal end 236 to a second distal end 238, the left and right sides 232, 234 comprising respective left and right slots 240, 242, each of the slots 240, 242 extending from a first end FE to a second end SE. The top wall 230 of the second section 204 comprises a recess 244 for receiving the underhanging portion 224 of the first section 202.

Figure 16:
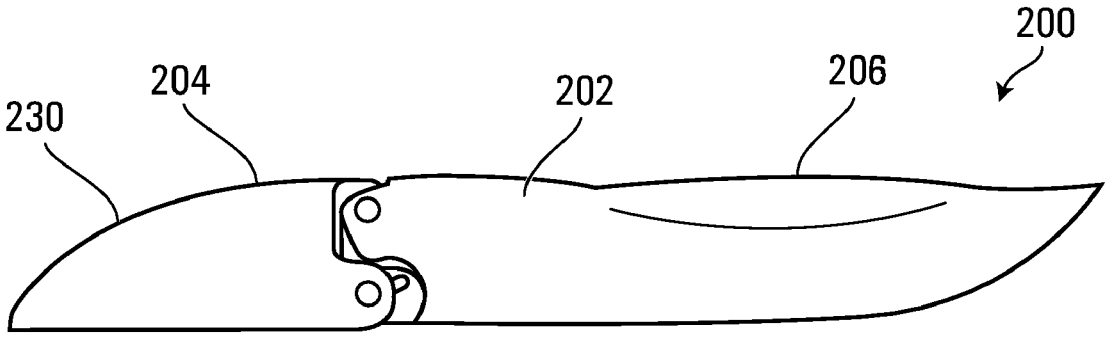
FIG. 16 is a side view of the thumb skeleton of FIG. 15 shown in an open position.
Figure 17:
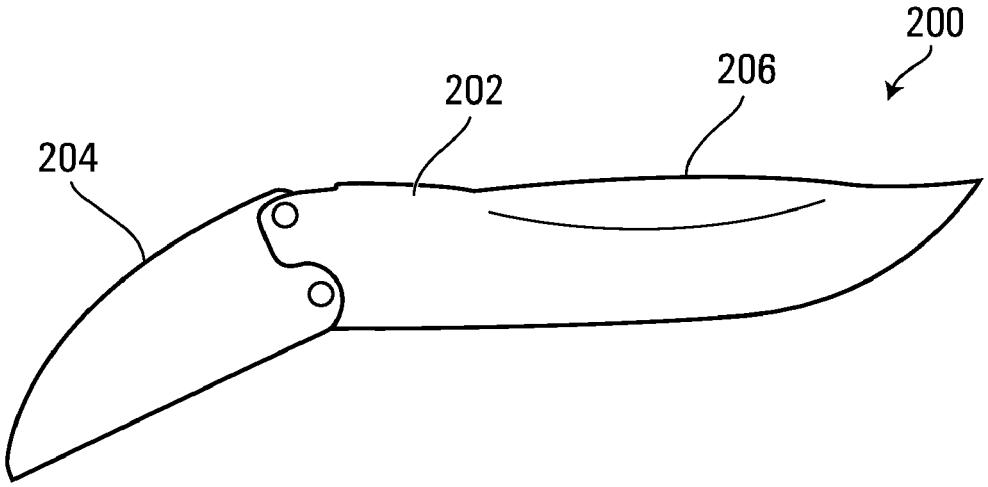
FIG. 17 is a side view of the thumb skeleton of FIG. 7 shown in a closed position.

The thumb skeleton 200 further comprises the rod 228 for connecting the underhanging portion 224 of the first section 202 within the recess 244 of the second section 204 such that the first and second sections 202, 204 are hinged together near the articulation between the proximal and middle phalanxes PP, MP of the thumb T and such that the first and second sections 202, 204 are rotatable relative to each other between a closed position (see FIG. 17) and an open position (see FIG. 16). The thumb skeleton 200 further comprises a left pin 246 passing through the left aperture 220 of the first section 202 and the left slot 240 of the second section 204 and a right pin 248 passing through the right aperture 222 of the first section 202 and the right slot 242 of the second section 204. Locking rings 250 are provided for retaining the respective pins 246, 248. The pins 246, 248 are moveable within the respective slots 240, 242. In use, when the first and second sections 202, 204 pivot relative to each other towards the closed position, each of the pins 246, 248 abuts the first end FE of each of the respective slots 240, 242 to prevent overbending of the thumb, and when the first and second sections 202, 204 pivot relative to each other towards the open position, each of the pins 246, 248 abuts the second end SE of each of the respective slots 240, 242 to prevent hyperextension of the thumb.

The above description of embodiments should not be interpreted in a limiting manner since other variations, modifications and refinements are possible within the spirit and scope of the present invention. The scope of the invention is defined by the appended claims and their equivalents.

The invention claimed is:

1. A hockey glove for enclosing a human wrist and hand, the hand having a dorsal side, a palm side, fingers and a thumb having a dorsal side, an inner side, a proximal phalanx, a middle phalanx, a distal phalanx and a middle articulation between the proximal and middle phalanxes and a distal articulation between the middle and distal phalanxes, said hockey glove comprising a hand-receiving portion comprising a palm side for facing the palm side of the hand; a dorsal side for facing the dorsal side of the hand; finger sheaths for receiving the fingers of the hand; and a thumb member comprising a top layer and a bottom layer affixed together at their respective peripheries for defining a cavity, a thumb pocket for receiving the thumb, and a rigid thumb skeleton enclosed in said cavity, said rigid thumb skeleton comprising a first section for covering at least partially the proximal phalanx of the thumb, a second section for covering at least partially the middle phalanx of the thumb and a third section for covering at least partially the distal phalanx of the thumb, wherein:

(a) said first section comprises a top wall and left and right sides extending longitudinally from a first proximal end to a first distal end, said top wall comprising an underhanging portion at said first distal end;

(b) said third section comprises a top wall and left and right sides extending longitudinally from a third proximal end to a third distal end, said top wall comprising an underhanging portion at said third proximal end;

(c) said second section comprises a top wall and left and right sides extending longitudinally from a second proximal end to a second distal end, said top wall comprising a proximal recess for receiving said underhanging portion of said first section and said underhanging portion of said third section, said second proximal end having a proximal slot extending between first and second ends, and said second distal end having a distal slot extending between first and second ends; and wherein said underhanging portion of said first section is affixed within said proximal recess of said second section for hinging together said first and second sections;

wherein said underhanging portion of said third section is affixed within said distal recess of said second section for hinging together said second and third sections;

wherein said first, second and third sections are rotatable relative to each other between a closed position and an open position;

wherein said rigid thumb skeleton further comprises a proximal pin passing through said proximal slot of said second section and a distal pin passing through said distal slot of said second section, said proximal pin being moveable within said proximal slot and said distal pin being moveable within said distal slot; and wherein, in use, when said second section pivots relative to said first section towards said closed position, said proximal pin abuts said second end of said proximal slot to prevent overbending of the thumb, and when said third section pivots relative to said second section towards said closed position, said distal pin abuts said first end of said distal slot to prevent overbending of the thumb; and when said second section pivots relative to said first section towards said open position, said proximal pin abuts said first end of said proximal slot to prevent hyperextension of the thumb, and when said third section pivots relative to said second section towards said open position, said distal pin abuts said second end of said distal slot to prevent hyperextension of the thumb.

2. The hockey glove as defined in claim 1, wherein said left and right sides of said first section comprises left and right portions extending forwardly at said first distal end and comprising respective left and right apertures, said left and right sides of said third section comprises left and right portions extending rearwardly at said third proximal end and comprising respective left and right apertures, and wherein said proximal pin passes through one of said left and right apertures of said first section and said distal pin passes through one of said left and right apertures of said third section.

3. The hockey glove as defined in claim 2, wherein said proximal slot is a left proximal slot provided at said left proximal end of said second section and said distal slot is a left distal slot provided at said left distal end of said second section, wherein said second section further comprises right proximal and distal slots provided at said respective right proximal and distal ends of said second section, wherein said proximal pin is a left proximal pin passing through said left aperture of said first section and said left proximal slot of said second section, wherein said distal pin is a left distal pin passing through said left aperture of said third section and said left distal slot of said second section, and wherein said rigid thumb skeleton further comprises a right proximal pin passing through said right aperture of said first section and said right proximal slot of said second section and a right distal pin passing through said right aperture of said third section and said right distal slot of said second section.

4. The hockey glove as defined in claim 3, wherein said underhanging portion of said first section has an aperture extending transversely for receiving a first rod connecting said first and second sections.

5. The hockey glove as defined in claim 3, wherein said dorsal side of said hand-receiving portion comprises a padded surface with dorsal pads for absorbing impacts.

6. The hockey glove as defined in claim 3 further comprising a flexible cuff surrounding the wrist and affixed to said hand receiving portion and a cuff roll extending at least partially over said flexible cuff.

7. The hockey glove as defined in claim 1, wherein said underhanging portion of said first section has an aperture extending transversely for receiving a first rod connecting said first and second sections.

8. The hockey glove as defined in claim 7, wherein said underhanging portion of said third section has an aperture extending transversely for receiving a second rod connecting said second and third sections.

9. The hockey glove as defined in claim 1, wherein said first and second sections are hinged together near the articulation between the proximal and middle phalanxes of the thumb.

10. The hockey glove as defined in claim 9, wherein said second and third sections are hinged together near the articulation between the middle and distal phalanxes of the thumb.

11. The hockey glove as defined in claim 1, wherein said dorsal side of said hand-receiving portion comprises a padded surface with dorsal pads for absorbing impacts.

12. The hockey glove as defined in claim 1 further comprising a flexible cuff surrounding the wrist and affixed to said hand receiving portion and a cuff roll extending at least partially over said flexible cuff.

13. The hockey glove as defined in claim 12, wherein said flexible cuff has a plurality of padded elements.

14. The hockey glove as defined in claim 13, wherein each said padded element partially overlaps an adjacent padded element.

15. The hockey glove as defined in claim 1 further comprising a reinforcing strip of material extending generally diagonally across said palm sheet.

16. The hockey glove as defined in claim 1 further comprising a pad made of an absorbing material, said pad being affixed to said palm sheet and located above the ulnar and mediale nerves of the hand.

17. A hockey glove for enclosing a human wrist and hand, the hand having a dorsal side, a palm side, fingers and a thumb having a dorsal side, an inner side, a proximal phalanx, a middle phalanx, a distal phalanx and a middle articulation between the proximal and middle phalanxes and a distal articulation between the middle and distal phalanxes, said hockey glove comprising a hand-receiving portion comprising a palm side for facing the palm side of the hand; a dorsal side for facing the dorsal side of the hand; finger sheaths for receiving the fingers of the hand; and a thumb member comprising a top layer and a bottom layer affixed together at their respective peripheries for defining a cavity, a thumb pocket for receiving the thumb, and a rigid thumb skeleton enclosed in said cavity, said rigid thumb skeleton comprising a first section for covering at least partially the middle phalanx of the thumb and a second section for covering at least partially the distal phalanx of the thumb, wherein:

(a) said first section comprises a top wall and left and right sides extending longitudinally from a first proximal end to a first distal end, said top wall comprising an underhanging portion at said first distal end;

(b) said second section comprises a top wall and left and right sides extending longitudinally from a second proximal end to a second distal end, said top wall comprising a recess for receiving said underhanging portion of said first section, said second proximal end having a slot extending between first and second ends, and wherein said underhanging portion of said first section is affixed within said recess of said second section for hinging together said first and second sections;

wherein said first and second sections are rotatable relative to each other between a closed position and an open position;

wherein said rigid thumb skeleton further comprises a pin passing through said slot of said second section, said pin being moveable within said slot; and wherein, in use, when said second section pivots relative to said first section towards said closed position, said pin abuts said first end of said slot to prevent overbending of the thumb; and when said second section pivots relative to said first section towards said open position, said pin abuts said second end of said slot to prevent hyperextension of the thumb.

18. The hockey glove as defined in claim 17, wherein said left and right sides of said first section comprises left and right portions extending forwardly at said first distal end and comprising respective left and right apertures, and wherein said pin passes through one of said left and right apertures of said first section.

19. The hockey glove as defined in claim 18, wherein said slot is a left slot provided at said left proximal end of said second section, wherein said second section further comprises a right slot provided at said right proximal end of said second section, wherein said pin is a left pin passing through said left aperture of said first section and said left slot of said second section, and wherein said rigid thumb skeleton further comprises a right pin passing through said right aperture of said first section and said right slot of said second section.

20. The hockey glove as defined in claim 19, wherein said underhanging portion of said first section has an aperture extending transversely for receiving a rod connecting said first and second sections.

21. The hockey glove as defined in claim 20, wherein said first and second sections are hinged together near the articulation between the proximal and middle phalanxes of the thumb.

* * * * *